US007918047B1

(12) United States Patent
Ngan

(10) Patent No.: US 7,918,047 B1
(45) Date of Patent: Apr. 5, 2011

(54) CORNER POCKET MOUNT FOR CARDS, PICTURES, MENUS AND THE LIKE

(76) Inventor: Chi Lung Ngan, Edison, NJ (US)

( * ) Notice: Subject to any disclaimer, the term of this patent is extended or adjusted under 35 U.S.C. 154(b) by 200 days.

(21) Appl. No.: 12/222,399

(22) Filed: Aug. 8, 2008

(51) Int. Cl.
*A47G 1/06* (2006.01)

(52) U.S. Cl. ..... 40/778

(58) Field of Classification Search ..... 40/124.06, 40/777, 778
See application file for complete search history.

(56) References Cited

U.S. PATENT DOCUMENTS

| | | | | |
|---|---|---|---|---|
| 739,315 | A | | 9/1903 | Hutton |
| 1,356,693 | A | | 10/1920 | Butler |
| 1,410,555 | A | | 3/1922 | Dexter |
| 1,493,159 | A | | 5/1924 | Milmoe |
| 1,999,423 | A | | 4/1935 | Riley |
| RE19,983 | E | | 5/1936 | Rado |
| 2,085,187 | A | | 6/1937 | Engel |
| 2,825,166 | A | * | 3/1958 | Flood ..... 40/778 |
| 3,256,979 | A | * | 6/1966 | Tschentschel ..... 206/345 |
| 4,598,825 | A | * | 7/1986 | Wiley et al. ..... 206/453 |

* cited by examiner

*Primary Examiner* — Joanne Silbermann
(74) *Attorney, Agent, or Firm* — Shlesinger, Arkwright & Garvey LLP

(57) ABSTRACT

A corner pocket mount for positioning cards, pictures, menus and the like on a frame comprising a pentagonal foldable slip including a rectangular component and a triangular component in which the triangular component reinforces the insert edge to reduce wear on the edges because of repeated changing cards, pictures, menus and the like.

2 Claims, 4 Drawing Sheets

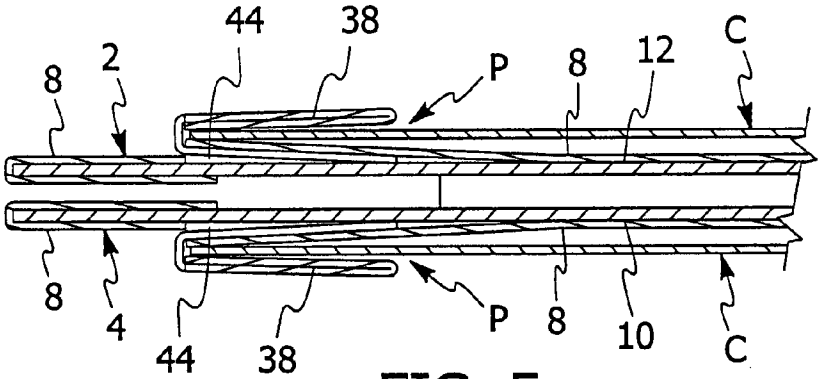
FIG. 5
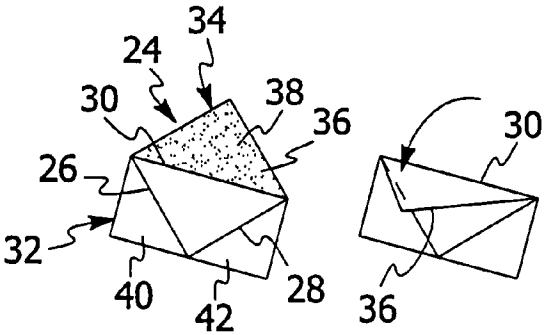
FIG. 6
FIG. 7
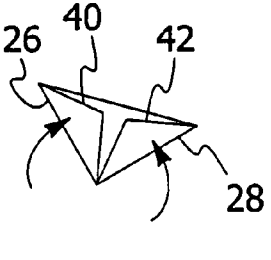
FIG. 8
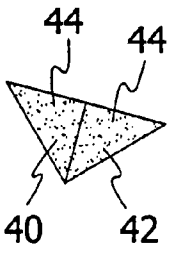
FIG. 9
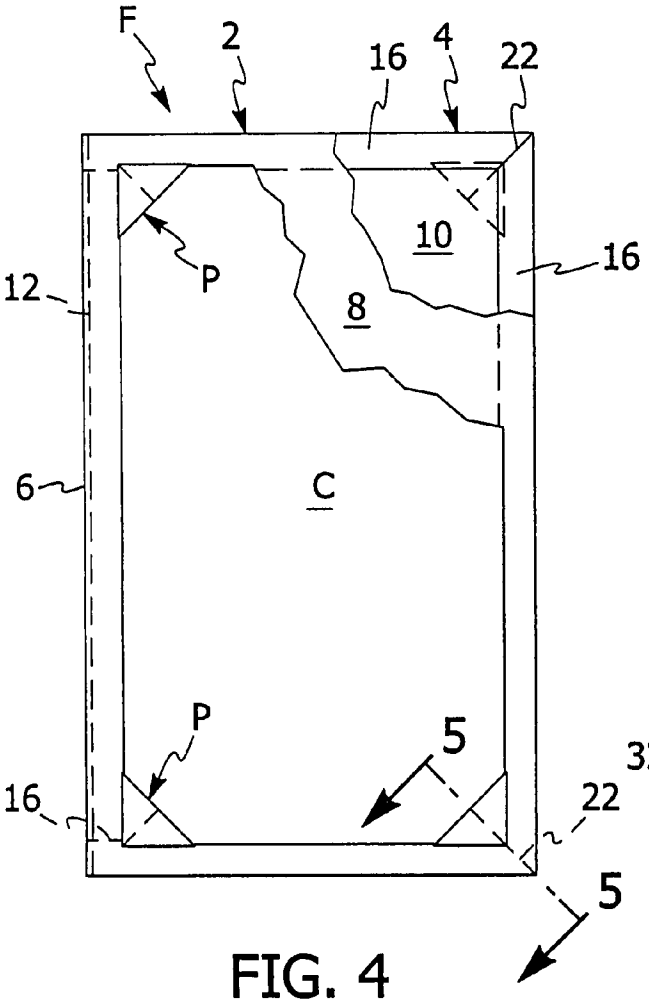
FIG. 4

CORNER POCKET MOUNT FOR CARDS, PICTURES, MENUS AND THE LIKE

FIELD OF THE INVENTION

This invention relates to corner mounting devices for securing cards, pictures, menus and the like on a frame and includes a reinforced lip to reduce the wear when material to be positioned is frequently removed and replaced with new items such as new menus, photographs or the like.

BACKGROUND HISTORY AND DEVELOPMENT

Card and picture mounts have been available for many years and early patents such Hutton U.S. Pat. No. 739,315 and Butler U.S. Pat. No. 1,356,693 illustrate mounts which are positioned in a slot in the frame.

Dexter U.S. Pat. No. 1,410,555, Milmoe U.S. Pat. No. 1,493,159, Riley U.S. Pat. No. 1,999,423, Rado Re 19,983 and Engel U.S. Pat. No. 2,085,187 show typical corner mounts using an adhesive to secure the mount to the frame.

None of the above references deal with reinforcing the entrance of the mount which becomes frayed and torn due to frequent insertion of new material.

OBJECTS AND SUMMARY OF THE INVENTION

It is an object of this invention to provide a corner pocket mount which is inexpensive and easily manufactured.

Yet another object of this invention is to provide a corner pocket mount which has a reinforced front edge to reduce wear and tear caused by frequent changes in cards, menus, pictures and the like.

Another object of this invention is to provide a corner pocket mount which can be permanently secured to the frame on which menus, pictures or the like will be displayed.

Another object of this invention is to provide a corner pocket mount which may be shipped in a flat condition and subsequently easily folded for positioning on the frame.

These and other objects of the invention will be apparent from the following description and the accompanying drawings which are as follows:

DRAWINGS

FIG. 4 is a top plan view of the assembly with bi-fold portions shown in phantom lines and portions broken away to show details;

FIG. 5 is an enlarged cross sectional view taken along the line 5-5 of FIG. 4 and viewed in the direction of the arrows;

FIGS. 6, 7, 8 and 9 progressively show the corner pocket mount from layout to final folding.

FIGS. 1 THROUGH 5

Figure 1:
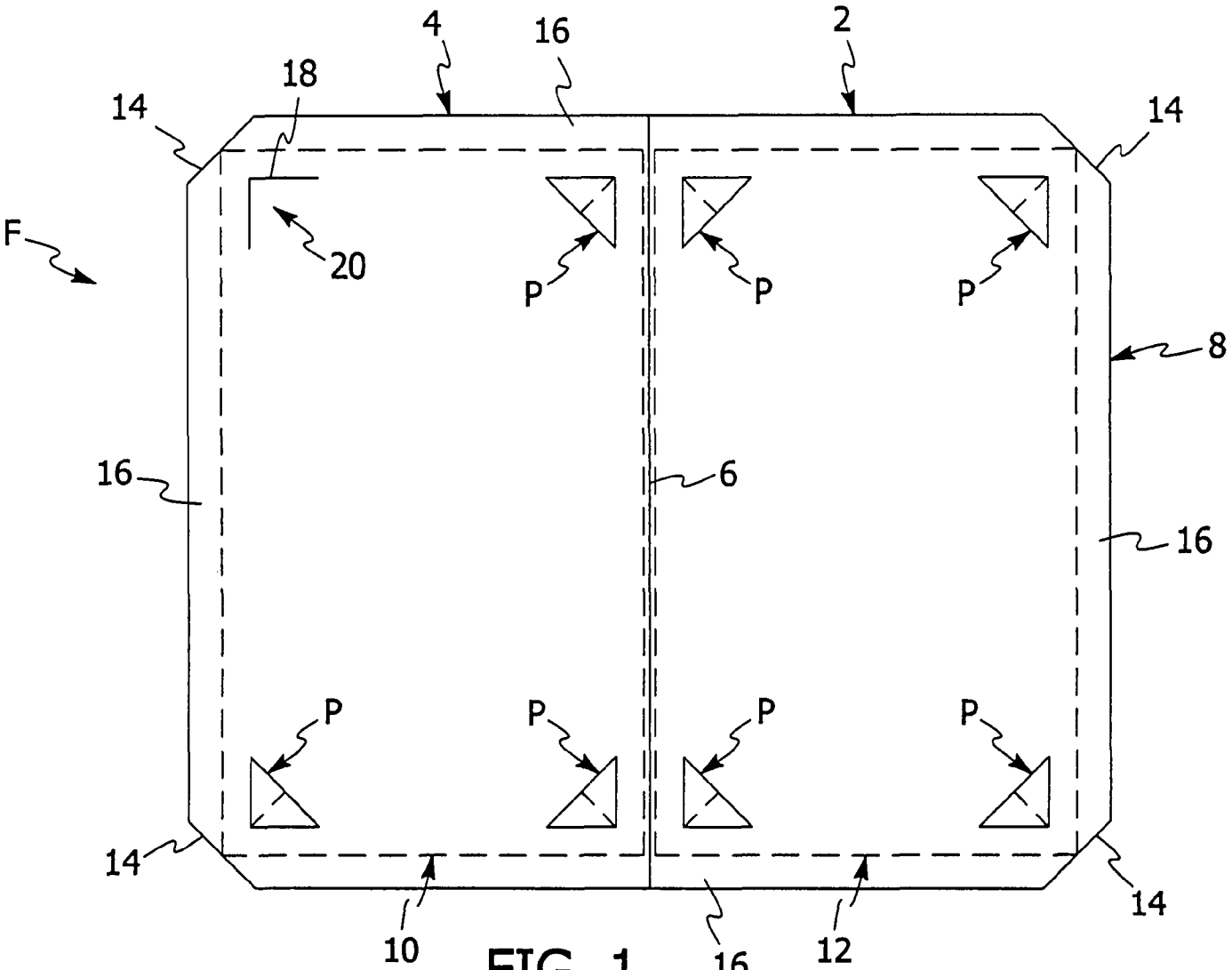
FIG. 1 is a top plan view prior to full assembly of a bi-fold frame portions shown in phantom lines.
Figure 2:
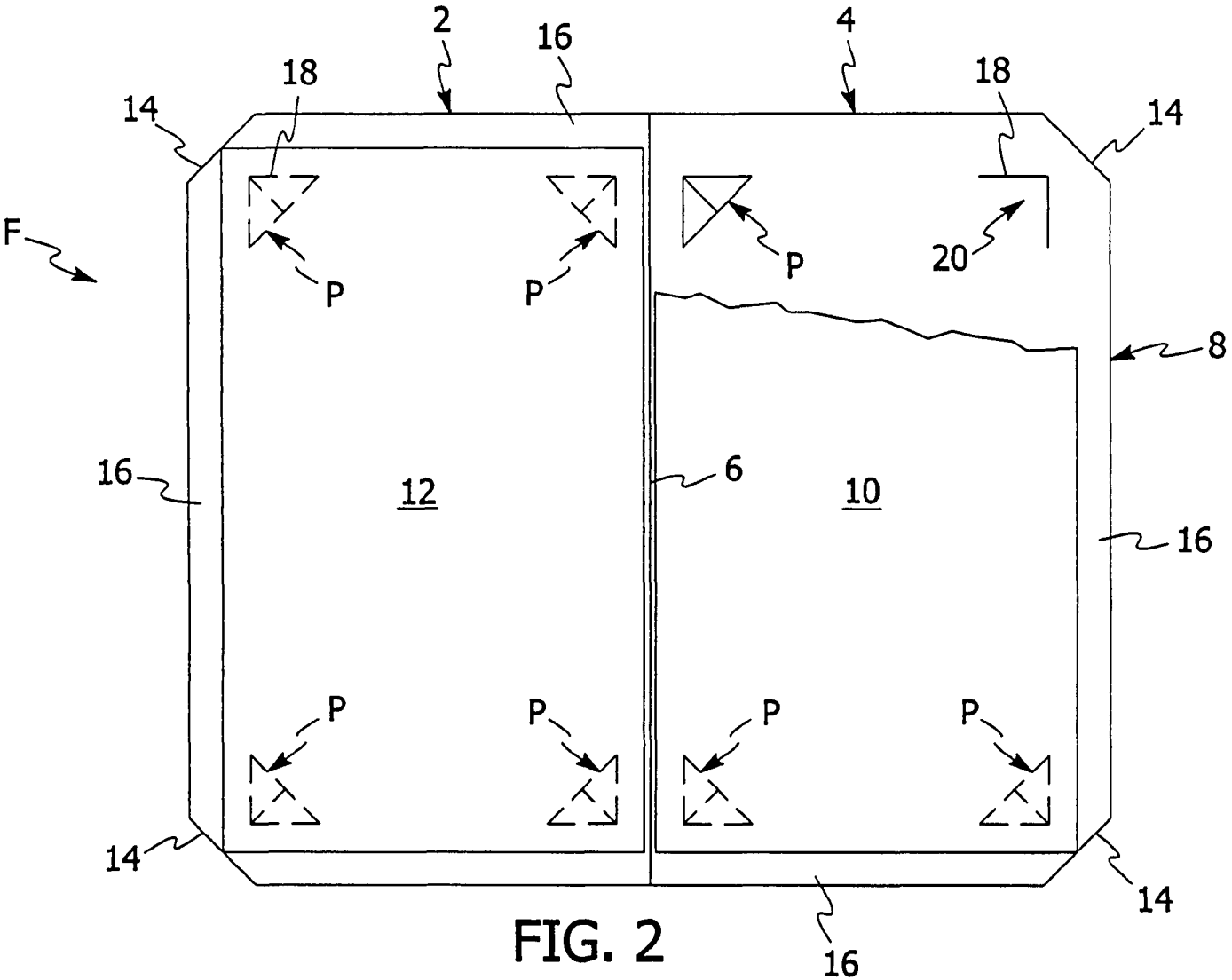
FIG. 2 is a bottom plan view prior to full assembly of the frame of FIG. 1 with portions shown in phantom lines and portions broken away to disclose detailed features.

As best shown in FIGS. 1 and 2, the frame F consists of bi-fold sections 2 and 4 foldable about a hinge 6. The frame F includes a cover sheet 8. The cover sheet 8 may be of paper stock, transparent material such as cellophane, leather or plastic or foil sheet material. Spaced backings 10 and 12 gives support to the cover sheet 8. The spaced backings 10 and 12 may be of cardboard or other stiff material. The cover sheet 8 has chamfered or beveled edges 14. It said be noted that the spaced backings 10 and 12 provide a marginal edge 16 to the cover sheet 8. As shown in FIGS. 1 and 2, right angle slots 18 form tongues 20 which receive the corner pocket mounts P.

FIGS. 3 AND 4

Figure 3:
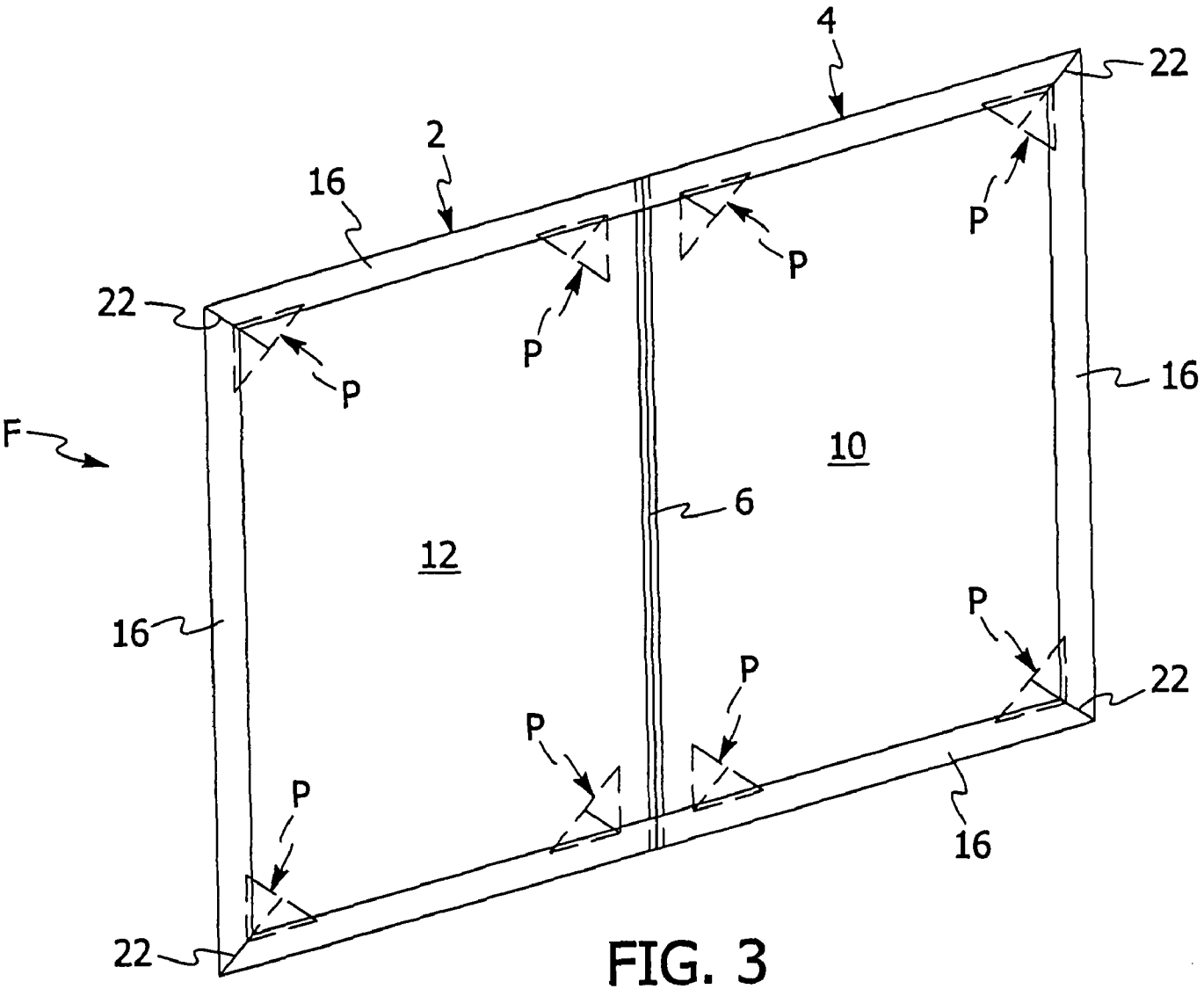
FIG. 3 is a bottom perspective of the bi-fold frame portions of which are shown in phantom lines.

In FIGS. 3 and 4, the marginal edges 16 are folded over the edges of the spaced backings 10 and 12 so that the chamfered or beveled edges 14 meet together at 22 as best shown in FIG. 3. The marginal edges 16 are glued or otherwise secured to the spaced backings 10 and 12. In FIG. 4, the card, picture or menu and the like C is shown positioned in the pockets P.

FIGS. 6, 7, 8 AND 9

In FIGS. 6, 7, 8 and 9 the corner pocket mount P is shown in a sequence of folding beginning with the planar slip 24 which is provided with score lines 26, 28 and 30. The planar slip 24 comprises a rectangular component 32 and a triangular component 34. The triangular component 34 is folded on the score line 30 which is the long edge of the rectangular component 32. The bottom or underside 36 of the triangular component 34 is provided with an adhesive 38 for securement to the rectangular component 32. Triangular flaps 40 and 42 are right triangles which are provided with glue 44 on the top surface. When triangular flaps 40 and 42 are folded down along the score lines 26 and 28, they form with the triangular component 34, which has been glued to the horizontal component 32, the corner pocket mount P. The corner pocket mount P is then positioned in the right angle slot 18 with the tongue 20 positioned in the pocket mount P for receipt of the card, picture, menu or the like C. The adhesive material 44 or the like is secured to the backing 10 or 12 as required.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention.

What is claimed is:

1. A corner pocket mount for positioning at least one of cards, pictures, and menus on a frame, said corner pocket mount comprising:

a) a folded pentagonal foldable slip;

b) said folded pentagonal foldable slip including a rectangular component and a triangular component;

c) said rectangular component having short and long sides;

d) said triangular component connected to one of said rectangular component's long sides;

e) said triangular component having a base connected to said rectangular component's one of said long sides;

f) said triangular component's base having a length equal to the length of said one of said long sides;

g) said triangular component having an apex in height equal to the length of said short sides;

h) said triangular component foldable along said one of said rectangular component's long sides onto the plane of said rectangular component providing a reinforcing front edge;

i) said triangular component being folded onto the plane of said rectangular component and delineating a pair of opposed right triangular flaps foldable over said triangular component and said triangular component being folded onto the plane of said rectangular component thus forming said corner pocket mount for receiving at least one of cards, pictures, and menus;

j) said pair of opposed right triangular flaps having top and bottom surfaces;

k) said top surfaces of the opposed right triangular flaps each including adhesive material for securing said corner pocket mount to a frame;

l) said triangular component having top and bottom surfaces;

m) said bottom surface of the triangular component including adhesive material for securing said triangular component to said rectangular component; and n) said triangular component top surface, with said triangular component bottom surface being secured to said rectangular component, being unattached to said pair of triangular flaps bottom surfaces when secured to a frame thereby forming an unobstructed pocket for receiving at least one of cards, pictures, and menus.

2. A corner pocket mount as in claim 1 and wherein:

a) said total area of said pair of opposed triangular flaps is equal to the area of said triangular component.

* * * * *